United States Patent [19]

Robran et al.

[11] 4,095,356

[45] Jun. 20, 1978

[54] BOOT WITH PIVOTED UPPER

[75] Inventors: David T. Robran; Charles S. French, both of Ketchum, Id.

[73] Assignee: Scott USA, Inc., Sun Valley, Id.

[21] Appl. No.: 732,906

[22] Filed: Oct. 15, 1976

[51] Int. Cl.[2] ..... A43B 5/04; A43B 21/00

[52] U.S. Cl. ..... 36/121; 36/105

[58] Field of Search ..... 36/120, 121, 105, 117, 36/50

[56] References Cited

U.S. PATENT DOCUMENTS

| | | | |
|---|---|---|---|
| 3,419,974 | 1/1969 | Lange | 36/120 |
| 3,713,231 | 1/1973 | Mochizuki | 36/121 |
| 3,861,067 | 1/1975 | Koyamor et al. | 36/120 |
| 3,945,134 | 3/1976 | Ramor | 36/121 |

*Primary Examiner*—Patrick D. Lawson

*Attorney, Agent, or Firm*—Wegner, Stellman, McCord, Wiles & Wood

[57] ABSTRACT

A sports boot such as used for skiing has an upper shell interconnected in the ankle region to a lower vamp shell by a pair of side primary pivots. The lower edge of the upper shell has an integrally molded front receptacle which faces a front receptacle integrally molded into the upper edge of the lower vamp shell. The receptacles hold a replaceable resilient insert, the vertical extent of which determines the forward lean angle of the upper shell, and the resiliency of which controls the flex characteristics of the upper shell when pivoted relative to the lower shell. The ends of the receptacles form overlapping stop flanges which abut a replaceable bumper having a vertical extent which controls the maximum rear lean angle of the upper. Rear entry into the boot is provided by a rear door connected by a pair of side door pivots to the upper, and which overlaps a separate replaceable heel door with interior padding for holding down the wearer's heel. When the rear door is swung downwardly, the heel door automatically opens rearwardly. In alternate embodiments, the resilient insert and bumper are augmented by an external piston and sleeve mechanism, and the rear door can be connected by side hinges to the upper.

23 Claims, 10 Drawing Figures

Fig. 1.
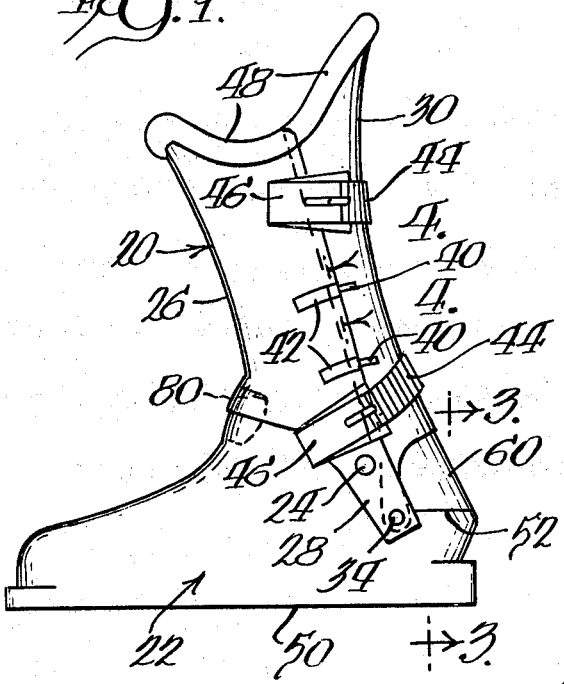
Fig. 3.
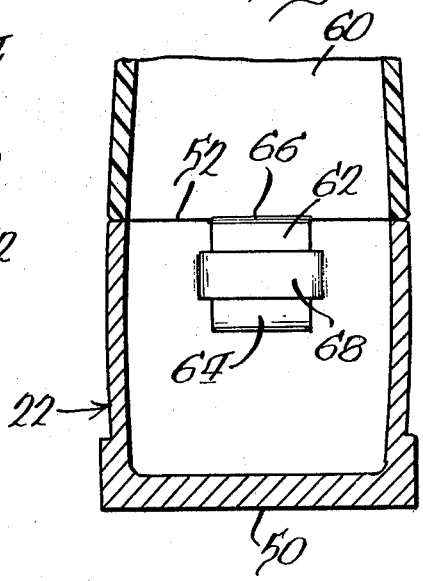
Fig. 2.
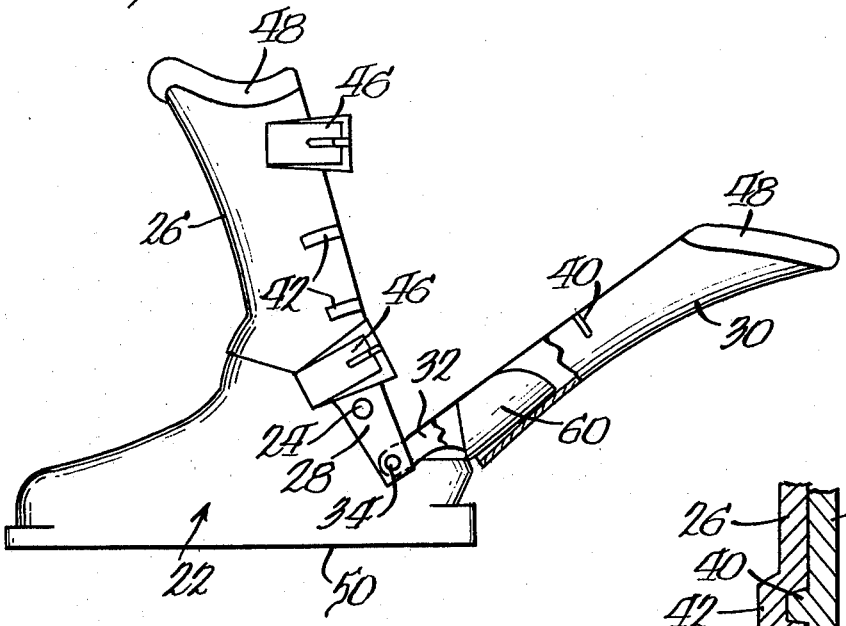
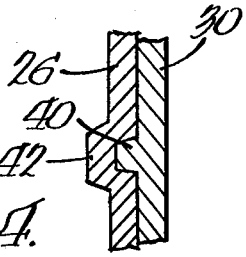
Fig. 4.

BOOT WITH PIVOTED UPPER

BACKGROUND OF THE INVENTION

This invention relates to a sports boot having a pivoted upper shell.

In a ski boot, the forward lean angle and the flex characteristic of an upper shell which is pivotally interconnected to a lower shell are important characteristics which should vary for skiers of different ability levels. Adjustability of the forward lean angle and the flex will allow one ski boot design to fit many different skiers, however, the adjustability should not be subject to inadvertent change while skiing.

Prior ski boots have used external hardware, generally mounted at the rear between the upper and lower shells, and incorporating spring means or resilient compressible material to control the flex between the upper and lower shells. The unflexed forward lean angle, or the maximum forward or rear angle during flexing, was often infinitely adjustable by movement of a stop such as a screw or sleeve. Unfortunately, such external hardware is exposed to the snow and freezing conditions, and creates an undesirable protrusion which can be dangerous. The adjustment mechanism could also inadvertently change during skiing.

To attempt to solve the problem of adopting one ski boot design to skiers of different ability levels, other ski boots have used internal mechanisms for controlling the forward lean angle and/or stiffness of the boot. Tension devices, located within the sole of the boot, have extended through channels to the upper shell to control the flex characteristics. The forward lean angle has been adjusted by stretching of the tension device, with the maximum forward lean angle being controlled by a sole located bumper which abutted the tension device. Unfortunately, this type of construction is unduly complex, increases assembly time, and adversely affects the ability of the ski boot to withstand extreme external forces. In still other ski boots, the stiffness adjustment has been accomplished by rotatable rods of varying cross section, housed within notches in the forward portion of a ski shell. Rotation of the rods would relatively block or open the space within the notches so as to control the stiffness of the shell. Such an arrangement does not allow adjustment of the forward lean angle, and is subject to inadvertent change during skiing.

Infinite adjustment of the forward lean angle and/or flex of an upper shell relative to a lower shell is not always desirable. While these adjustments should be different for skiers of different ability levels and/or strength, it seldom should be necessary to change the adjustment once selected until a particular skier has experienced a significant change in ability and/or strength.

Various entry systems have been devised for side or rear entry of a foot into the upper shell of a ski boot. Rear entry systems are less likely to interfere with the forward flexing action of an upper shell relative to a lower shell. Some rear entry doors, when closed, have been fixed with respect to the vamp shell, causing undue rubbing of the rear door against the skier's lower leg as the leg moves forwardly and rearwardly within the upper shell. To minimize stresses on the upper shell, the rear door has been of narrow width, thus making rear entry difficult. Furthermore, a vamp shell with a high back, sufficient to encompass the heel of a skier's foot, has been necessary to distribute to the vamp shell the forces which urge a skier's heel rearward during skiing. Unfortunately, such an arrangement requires the skier's foot to be lowered into the vamp shell, losing some advantages of a rear entry system, and making it difficult to provide adequate heel hold-down forces.

SUMMARY OF THE INVENTION

In accordance with the present invention, the disadvantages noted above have been overcome in a sports boot having a pivoted upper shell and a rear entry system. A single, replaceable resilient body, housed between upper and lower receptacles in the upper and lower shells, controls both the flex and the forward lean angle of the boot. The flex and/or the forward lean angle can be readily changed by replacing the resilient body with a resilient body of different dimensions and/or resiliency characteristics. A replaceable bumper controls the maximum rear lean angle of the boot. Once in place, the resilient body and bumper prevent inadvertent change in the forward lean angle or flex of the boot.

A rear entry system includes an openable rear door which allows easy access to the boot. A separate replaceable heel door provides the necessary heel hold-down forces, and is maintained in position by the overlapping rear door. The replaceable heel door has a custom padding which fits the individual skier's requirements.

The rear door is connected by a pair of secondary pivots to a front upper shell segment which in turn is connected by a pair of primary pivots to the lower vamp shell. The heel door is connected to the lower vamp shell by a resilient hinge molded in an open position so that the heel door automatically opens as the rear door is pivoted backwardly. To prevent chafing, the entire upper assembly moves with the skier's lower leg, and the entire lower assembly including the heel door remains fixed with respect to the foot. In other embodiments, the rear door is hinged at the side to the pivoted upper shell, and an external piston and sleeve mechanism augment the resilient body and bumper for competitive conditions.

While the above improvements are especially advantageous in ski boots, it should be understood that some of the advantages are applicable to other sports boots, such as used for motorcycle racing. For example, the adjustable flex system is applicable to a freely pivoted upper shell by eliminating the stops for locking the upper shell. In addition, the resiliency of the resilient body and the bumper would be selected to be very soft compared to the resiliency which would be selected for a ski boot.

One object of the present invention is the provision of a boot having a replaceable resilient body, located between pivoted upper and lower shells, to control the flex and forward lean angle of the boot. A replaceable bumper may be located between stop flanges on the upper and lower shells to control the maximum rear lean angle of the upper shell.

Another object of the present invention is the provision of a boot having an upper shell pivoted to a lower shell, with a rear entry system consisting of a rear door movable with the pivoted upper and a separate heel door fixed with respect to the lower shell. The upper assembly is pivoted in the vicinity of the wearer's ankle by a pair of primary pivots, and the rear door is connected by a pair of secondary pivots to a front upper segment. The heel door is removable and is molded in an open position, with the overlapping rear door maintaining the heel door in a closed position during use.

Other objects and features of the invention will be apparent from the following description and from the drawings. While illustrative embodiments of the invention are shown in the drawings and will be described in detail herein, the invention is susceptible of embodiment in many different forms and it should be understood that the present disclosure is to be considered as an exemplification of the principles of the invention and is not intended to limit the invention to the embodiments illustrated.

BRIEF DESCRIPTION OF THE DRAWINGS

FIG. 1 is a side plan view of a boot constructed in accordance with the present invention.

FIG. 2 is a side plan view, similar to FIG. 1, with the pivoted rear door and the heel door opened to permit rear entry into the boot.

FIG. 3 is an enlarged rear sectional view of the heel door and lower vamp shell, taken along lines 3—3 of FIG. 1.

FIG. 4 is an enlarged front sectional view of the lip and groove interlock for the front upper shell and the rear door, taken along lines 4—4 of FIG. 1.

DESCRIPTION OF THE PREFERRED EMBODIMENTS

Figure 5:
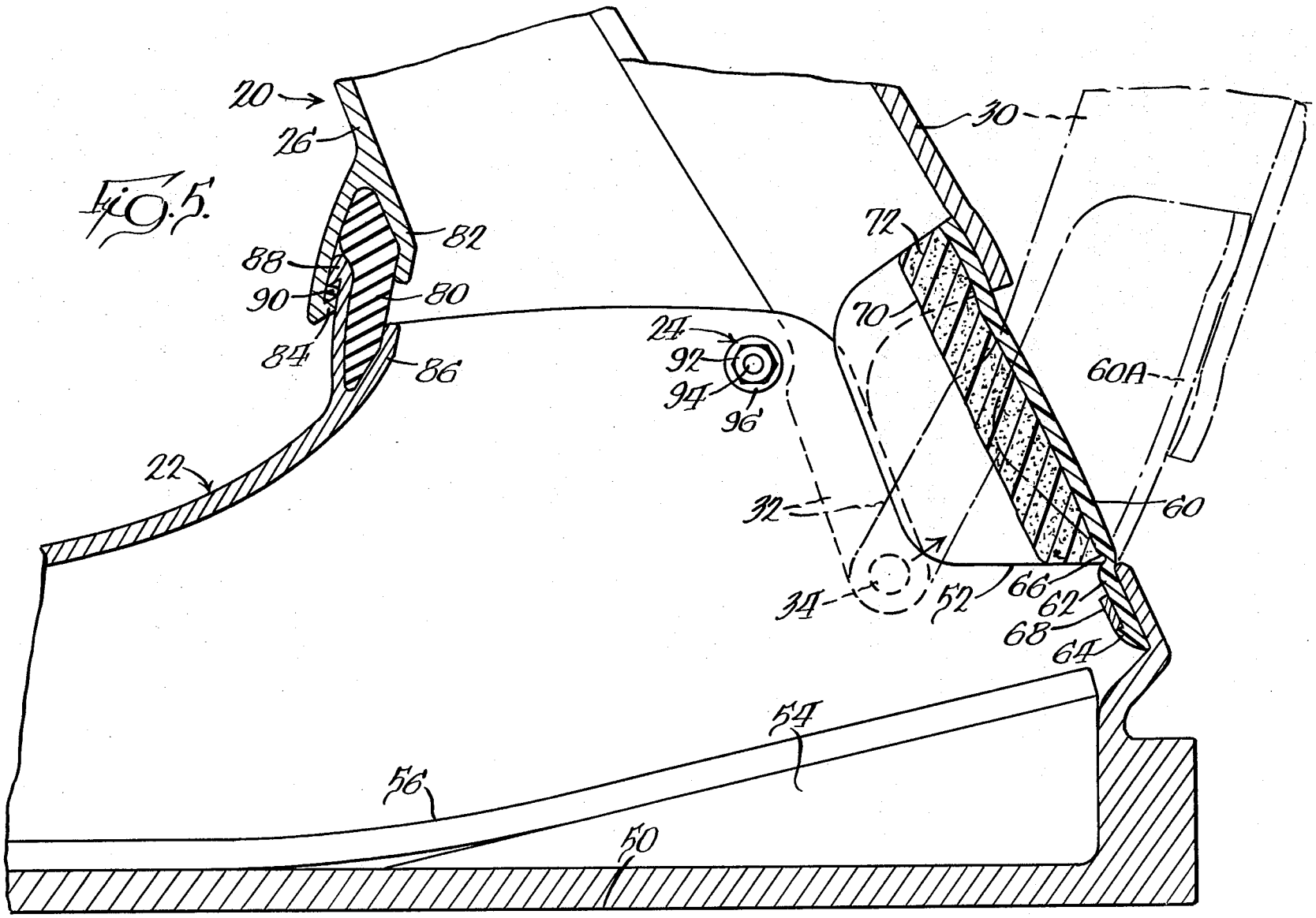
FIG. 5 is an enlarged side sectional view of the boot (with some of the inner liners and padding removed for clarity).

Turning to FIGS. 1–5, a ski boot includes a rigid plastic upper shell assembly 20 which is interconnected to a rigid plastic lower vamp shell 22 by a pair of boot or primary pivots 24 located on each side of the boot in the vicinity of a skier's ankle. Upper shell assembly 20 includes a generally semi-cylindrical front secion 26 having a pair of side legs 28 extending downwardly past the ankle location of the pivots 24. Upper assembly 20 further consists of a separate, generally semi-cylindrical rear door 30 having a pair of side legs 32 extending downwardly and inside the front legs 28. A pair of door or secondary pivot pins 34 rotatably interconnect the pair of front legs 28 with the pair of door legs 32 vertically below and somewhat to the rear of the primary pivots 24 so as to increase the size of the rear opening. The pivot pins 34 have enlarged smooth heads which freely slide against the exterior of the vamp when the entire upper assembly 20 is pivoted forwardly and rearwardly about the primary pivots 24.

Rear door 30 can be swung open to the rear about pivots 34, as shown in FIG. 2, to expose the entire interior of the upper shell assembly. As the rear door 30 is returned to its closed position, a pair of tongues 40, FIG. 4, which extend outwardly from both sides of the rear door, are slidably received within grooves of a pair of raised channels 42 integrally molded on both sides of the upper front section 26. The tongues 40 and the grooves within channels 42 have a slight curvature with a center point at the secondary pivots 34. The tongues 40 in the grooves of channels 42 from an interlock to reduce stress on the secondary pivot pins 34, which accordingly can be of smaller size than would otherwise be necessary.

After the tongues 40 are fully received within the grooves on both sides of the front upper section, a pair of straps 44, secured near one edge of the upper front section 26, are wrapped around the rear door and inserted within buckles 46, secured near the opposite edge of the upper front section 26. After being tightened by the buckles 46, the upper front section 26 and the rear door 30 form a unitary upper cylinder, which pivots forwardly and rearwardly with forward and rearward movement of a skier's leg about the primary pivots 24. The door closure system 44, 46 may take other forms, such as an adjustable length wire which is tightened by a buckle. An inner liner or padding 48 is fitted to the interior of the front section 26 and rear door 30, and may extend over the top of the upper shell assembly, as shown in FIGS. 1 and 2.

Lower vamp shell 22 has a sole 50 molded integrally with the upper portions of the vamp. The upper edge of the vamp defines a foot receiving opening having a heel cut-out formed by a lowered or recessed rear edge 52 adjacent the skier's heel. To custom fit the boot shell to a particular skier's foot, a semi-resilient wedge 54, FIG. 5, is inserted against the bottom of the sole 50, and a resilient foot liner 56 is placed over the wedge 54 so as to create an inclined surface for supporting the bottom of a skier's foot. These inserts or liners raise the skier's heel sufficiently so that the recessed rear edge 52 exposes a portion of the skier's heel. The resulting heel opening in the vamp is covered by a separate heel door 60 which is replaceable as will appear.

Heel door 60 is formed by a generally U-shaped cuff having an integral tab 62 extending downwardly from the center of the cuff and terminating in a hook 64, see FIGS. 3 and 5. The rear door 60 is molded from a flexible urethane incorporating a living hinge 66 molded relative to tab 62 with the cuff in the open position 60A shown in dashed lines in FIG. 5, so that the door will automatically return to the position 60A when external forces against it are released. The tab 62 is inserted through a loop receptacle 68 integrally molded at the rear of the vamp, with the hook 64 snapping outwardly after insertion to replaceably lock the heel door 60 to the lower vamp.

The inner side of the heel door 60 mounts a flexible liner or padding, in the form of a sack 70 containing a flow material 72 which moves responsive to constant pressure so as to mold around and form a snug fit with the skier's heel. To custom fit the interior of the boot to different skier's feet, a variety of heel doors 60 with different thickness padding 70 are made available. If a padding of different thickness is desired, the hook 64 can be depressed and lifted upwardly, after which a heel door 60 having a different thickness padding is inserted in the loop 68. Also for custom fitting the boot to a particular foot, a flexible inner liner (not shown in FIG. 5) is inserted into the vamp. The thickness of the liner may be varied as necessary.

The rear entry system allows easy access to the interior of the upper and lower shells. In the closed skiing position, the heel door 60 is held closed by the overlapping rear door 30 and withstands the rearward forces which are exerted against the skier's heel. Because the heel door 60 is vertically fixed with respect to the vamp 22 and contains the heel of the skier's foot, which remains relatively fixed with respect to the sole 50 during skiing, no chafing against the foot will occur. Furthermore, the entire upper assembly including the front section 26 and the rear door 30 pivot about the skier's ankle, also preventing chafing of the lower leg. The bottom edge of the rear door 30 slides in sealing engagement against the outer surface of the heel door 60. When the rear door 30 is swung open, the living hinge 66 causes the heel door 60 to automatically swing rearwardly and stay in contact with the rear door 30. Other methods could be used to cause the heel door 60 to automatically move with the rear door 30, such as a finger which extends from the rear door into an external loop on the heel door, in which case the heel door could be connected to the vamp by a lower hinge assembly, similar to that described later with respect to FIGS. 8–10.

To control the flex characteristics and the forward lean angle of the upper shell, a resilient block or body 80 is located at the front of the ski boot between the upper and lower shells. The wall of the upper shell segment 26 separates to define a recessed pocket or upper receptacle 82 located in the terminating lower edge of the shell. The outer wall of the upper receptacle has an inwardly extending stop flange 84. The wall of the vamp shell 22 also separates, at the front of the foot receiving opening, into a recessed pocket or lower receptacle 86. The outer wall of the lower receptacle has an outwardly extending stop flange 88 located to interlock flange 84 if the upper shell were pivoted rearwardly by a sufficient amount.

As the upper shell is pivotally moved or flexed forwardly and rearwardly, the volume or space between the receptacles 82, 86 is compressed and expanded, respectively. The resilient body 80 is housed within this space so as to resist forward movement of the upper shell assembly. The resilient body is formed of a resilient urethane, rubber or other deformable, elastomeric material which can be compressed and will return to its original shape. Its resiliency controls the resistance to forward movement, or "flex" of the upper shell assembly.

The size or dimensions of the resilient body 80, in particular its vertical extent or height, controls the unflexed forward lean angle of the upper shell assembly relative to the lower vamp shell. For a resilient block 80 of particular height, a bumper 90 is inserted so as to fill the gap between the interlocking stop flanges 84, 88. The bumper may be relatively incompressible or may be resilient to cushion and reduce the shock when stopping rearward travel of the upper shell assembly. The stop flanges 84, 88 and the bumper 90 when compressed its maximum amount, control the maximum rear lean angle for the boot. If the bumper 90 fills the entire gap between the stop flanges 84, 88 and is selected to be essentially incompressible, then the maximum rear lean angle will equal the unflexed forward lean angle. By selection of a variety of shapes and resiliencies for the body 80 and bumper 90, a variety of boot variations are possible according to the needs and preference of any particular skier.

Primary boot pivots 24 can be disassembled to allow the resilient block 80 and bumper 90 to be replaced with materials of different size dimensions and/or resiliency characteristics so as to change the lean angles and the flex characteristics of the boot. Each pivot 24 includes a nut 92, see FIG. 5, which threads on the shank 94 of a detachable pivot pin. A lock washer 96 prevents inadvertent release of the nut 92. When the block 80 and bumper 90 are to be replaced, the vamp inner liner (not shown in FIG. 5) is removed and the nuts 92 are unthreaded so as to allow release of the pair of pivot pins. The upper shell assembly can be manipulated so that the interlocking stop flanges 84, 88 clear the bumper 90 and is then lifted away from the lower vamp.

Figure 6:
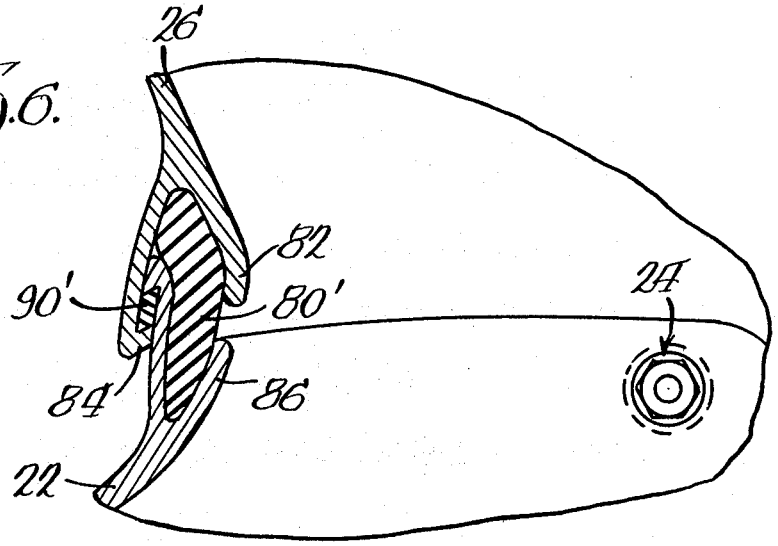
FIG. 6 is an enlarged side sectional view, similar to the left hand portion of FIG. 5, showing the boot with a different size resilient block and bumper.
Figure 7:
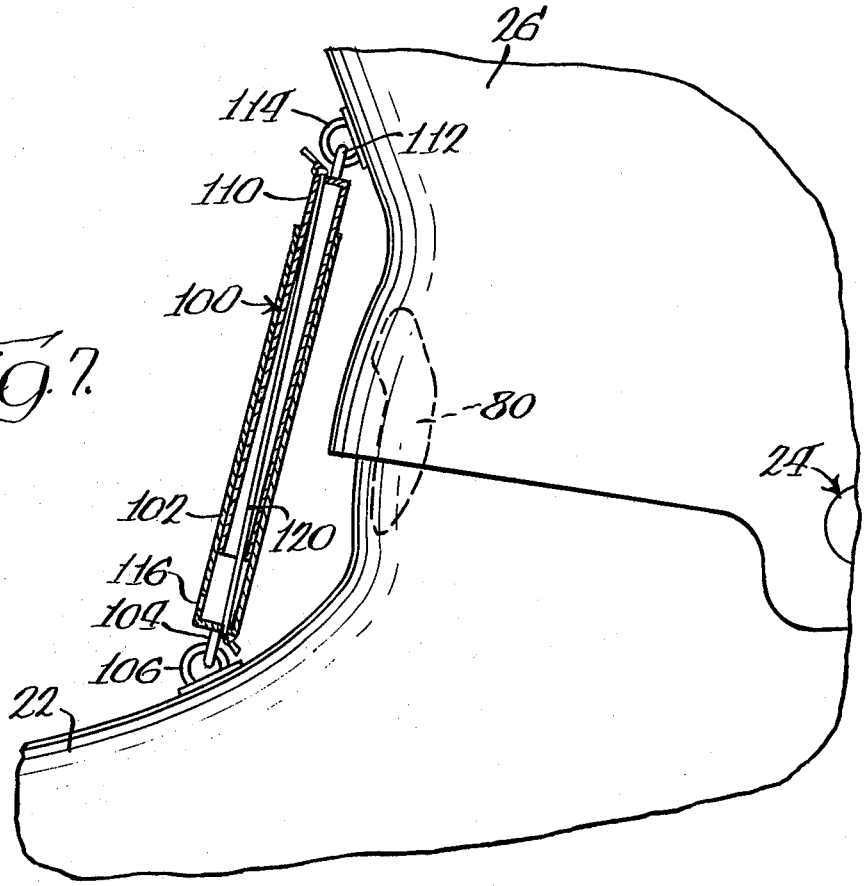
FIG. 7 is an enlarged side plan view of an alternate embodiment using an external piston and sleeve mechanism to augment the internal resilient block and bumper system.

As seen in FIG. 6, a resilient block 80' of smaller vertical extent could be inserted within the compressible front cavity, along with a bumper 90' of a greater vertical height, so as to increase the forward lean angle over that shown in FIG. 5. Generally, a greater forward lean angle is desired by better skiers, and a harder or stiffer flex is desired by skiers of better ability levels.

For competition conditions where extreme forces may be present, the resilient block 80 and bumper 90 may be augmented by an external assembly 100, seen in FIG. 6. The assembly 100 comprises an outer cylindrical sleeve 102 which is secured by a ring 104 to a ring 106 riveted to the vamp 22. An inner piston or cylindrical sleeve 110 has a ring 112 secured to a ring 114 riveted to the upper shell 20. An air vent 116 in the outer sleeve 102 causes the pair of sliding sleeves to act as a piston and cylinder with the fluid medium being air. The maximum amount to which the sleeves can extend is controlled by a cable 120 which is secured through holes in the ends of both sleeves. This controls the maximum rear lean angle of the upper shell assembly.

Figure 8:
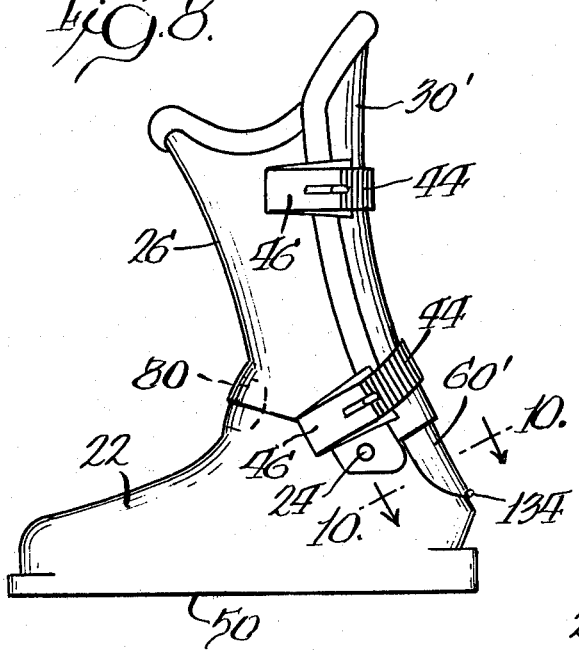
FIG. 8 is a side plan view, similar to FIG. 1, of an alternate embodiment using a side hinged rear door.
Figure 9:
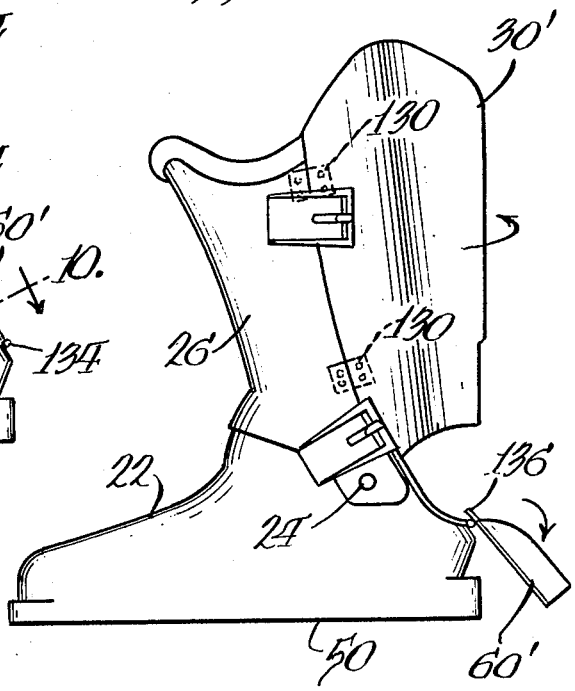
FIG. 9 is a side plan view, similar to FIG. 8, with the hinged rear door and the heel door opened to permit rear entry into the boot.
Figure 10:
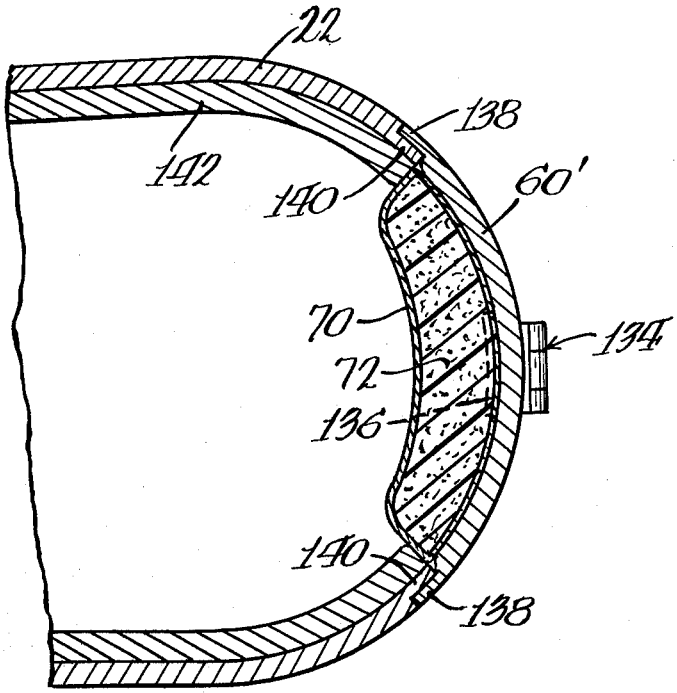
FIG. 10 is an enlarged top sectional view of the heel door and lower vamp, taken along lines 10—10 of FIG. 8.

A modified form of a rear entry system is shown in FIGS. 8–10. Components of the boot which are the same as the embodiment of FIGS. 1–5 have been identified with the same reference numerals. The rear door 30' is connected by a pair of side hinges 130 to the front upper section 26. The heel door 60' is interconnected by a hinge 134 to the center rear of the vamp shell 22. When rotated rearward as shown in FIG. 9, the skier's foot has easy access to the interior of the lower vamp shell 22.

Heel door 60' includes an extending tab 136, riveted to the bottom of door 60' and to the hinge assembly 134, to provide a stop for the heel door. The sides of the heel door have a peripheral flange 138, of reduced thickness, which abuts the reduced thickness side 140 of the heel opening. The upper section of the heel door 60' is curved and has a fixed radius with a center intersecting a line between the pair of pivots 24. As in the previous embodiment, the heel door 60' can be detached and replaced with a door having a different thickness padding 70 in order to custom fit the boot to a particular skier. The removable inner liner 142, which custom fits the boot for a particular skier, is also shown in FIG. 10.

Various changes can be made to the ski boot embodiments described above. Although the resilient block 80 has been illustrated as housed equidistant between the pivot points (and at the front although the rear is also possible), which results in maximum compression per increment of movement of the shells, it will be appreciated that it could be located wherever the upper and lower shells relatively compress and expand. For example, a pair of pockets could be located on the side regions of the shell, in front of or behind the pivot points.

While the maximum rear tilt is controlled by the bumper 90 and stop flanges 84, 88, the stop surfaces could be located in the rear of the ski boot, by means of the upper shell coming into contact with a stop shelf on the lower heel door 60.

In boots where the lean angle should not be present, such as in a motorcycle racing boot, the stop flanges 84, 88 and the bumper 90 could be eliminated, and the resilient block 80 could be selected to be of much softer resiliency so as to provide a controlled soft flex for a freely pivoted upper shell. In such a case, an additional pocket and resilient block could be located in the rear of the boot, so as to provide both forward and rearward control of flexing, with independent amounts of flexing if so desired. Alternatively, the stop flanges 84, 88 could be altered to form an increased size cavity which would hold a second resilient block of soft resiliency. Thus, the pair of resilient blocks could be located adjacent each other. Other modifications will be apparent in view of the above teachings.

We claim:

1. A boot comprising:

a lower vamp shell having a foot receiving opening defined by an outer wall which includes a lower pocket, an upper shell having an outer wall which includes an upper pocket facing the lower pocket and forming therewith an interior cavity enclosed at least by overlapping outer walls of the upper and lower pockets, pivot means for pivotally interconnecting the upper shell to the lower shell to allow forward and rearward motion of the shells and resulting sliding movement between the overlapped outer walls of the upper and lower pockets; and a resilient body mounted within the interior cavity and compressed during sliding motion between the overlapped pockets to control the flex characteristics between the upper and lower shells.

2. The boot of claim 1 wherein the entire outer wall of the upper shell overlaps the outer wall of the lower shell and the upper and lower pockets are formed by recessed wall openings located at the terminating edges of the overlapping upper and lower shells and are spaced approximately equidistant from the pivot means so that the openings have maximum relative movement therebetween during pivoting motion of the shells.

3. A boot comprising:

a lower vamp shell having a foot receiving opening which includes an outer wall and a receptacle wall spaced from a portion of the outer wall to define a lower pocket, an upper shell having a front section which contains an outer wall which overlaps the outer wall of the lower vamp shell at least adjacent the lower pocket, a receptacle wall extending from a portion of the outer wall of the front section to define an upper pocket in the forward terminating edge of the upper shell and facing the lower pocket to form a cavity, a rear door section interconnected to the front section and openable to allow rear entry into the boot, and closure means for securing the rear door section to the front section after entry into the boot;

pivot means for pivotally interconnecting the upper shell to the lower shell to allow forward and rearward motion of the shells and resulting sliding movement between the overlapped outer walls and relative movement between the upper and lower pockets; and a resilient body mounted within and extending between the upper and lower pockets and compressed during pivoting motion between the overlapped shells to control the flex characteristics therebetween.

4. The boot of claim 3 wherein the lower vamp shell includes a heel door located at the rear of the vamp and openable to expose the interior of the vamp, the rear door of the upper shell overlapping the heel door and sliding thereagainst during pivoting motion of the shells.

5. The boot of claim 1 wherein the resilient body is replaceable with a resilient body of different resiliency so as to change the flex characteristics of the boot, and the pivot means includes a pair of pivot pins located on opposite sides of the shells for releasably interconnecting the upper and lower shells, the pivot pins being releasable to allow removal of the upper shell for replacement of the resilient body.

6. A boot comprising:

a lower vamp shell having a foot receiving opening defined by an edge which includes a lower receptacle, an upper shell having a lower edge which includes an upper receptacle generally facing the lower receptacle, pivot means for pivotally interconnecting the upper shell to the lower shell to allow forward and rearward motion of the shells and resulting relative movement between the upper and lower receptacles, and a resilient body mounted between the upper and lower receptacles and compressed during pivoting motion between the shells to control the flex characteristics therebetween, the vertical extent of the resilient body controlling the forward lean angle of the upper shell with respect to the lower shell, the resilient body being replaceable with a resilient body of different vertical extent to thereby change the forward lean angle of the boot.

7. A boot comprising:

a lower vamp shell having a foot receiving opening defined by an edge which includes a lower receptacle with an extending stop flange, an upper shell having a lower edge which includes an upper receptacle with an extending stop flange, the upper receptacle generally facing the lower receptacle, pivot means for pivotally interconnecting the upper shell to the lower shell to allow forward and rearward motion of the shells and resulting relative movement between the upper and lower receptacles, a resilient body mounted between the upper and lower receptacles and compressed during pivoting motion between the shells to control the flex characteristics therebetween, and a bumper mounted between the stop flanges for controlling the maximum rear lean angle of the upper shell with respect to the vamp shell.

8. A boot comprising:

an upper shell having a body mounting means, a lower vamp shell having a body mounting means, pivot means interconnecting the upper shell to the lower shell for pivoting motion of the upper shell relative to the lower shell and resulting movement between the body mounting means, a replaceable body held by and urging apart the body mounting means so that the size of the replaceable body controls the angle of forward lean of the upper shell relative to the lower shell.

9. The boot of claim 8 wherein the replaceable body is resilient and is compressed by the body mounting means to control the amount of force needed to pivot the upper shell relative to the lower shell.

10. The boot of claim 8 wherein the pivot means is detachable to allow detachment of the upper shell from the lower vamp shell and thereby allow replacement of the body with a body of different size to change the forward lean angle.

11. The boot of claim 8 including a bumper having a size which controls the maximum angle to which the upper shell can be pivoted in one direction with respect to the lower shell, and the body mounting means include first and second stop flanges which engage the bumper to lock the upper shell to the lower shell when the sto flanges are rotated against the bumper.

12. The boot of claim 8 including an external device connected between the upper shell and the lower vamp shell for augmenting the body, the external device including a piston movable within a sleeve for controlling the flex of the upper shell relative to the lower shell, and a member for limiting the amount of movement of the piston relative to the sleeve.

13. The boot of claim 8 wherein the body mounting means on the upper shell comprises a downwardly facing opening in the wall of the upper shell, the body mounting means of the lower shell comprises an upwardly facing opening in the wall of the lower shell, the downwardly facing opening and the upwardly facing opening being adjacent to define a cavity having a varying volume as the upper shell pivotally moves with respect to the lower shell, and the replaceable body substantially filling the cavity.

14. A boot comprising:

a lower vamp shell having a recessed rear edge adjacent a wearer's heel and a front edge with a split wall defining a lower pocket, a heel door covering the recessed rear edge and openable to allow rear entry of a foot into the vamp shell, an upper shell assembly including a front section with a lower edge having a split wall which defines an upper pocket facing the lower pocket and a rear door interconnected to the front section and openable to allow rear entry of a leg into the upper shell assembly, the rear door when closed overlapping the heel door, closure means for securing the rear door against the front section of the upper shell, a resilient body located between the lower and upper pockets, and pivot means for pivotally interconnecting the upper shell assembly to the lower vamp shell for pivoting motion of the upper shell assembly with resulting sliding motion of the rear door against the heel door and compression and expansion of the resilient body.

15. The boot of claim 14 including a lock receptacle located in the interior of the vamp shell adjacent the recessed rear edge, and the heel door includes a tab which extends into the receptacle for locking the heel door to the vamp shell, the tab forming a hinge for allowing the heel door to rotate outwardly.

16. The boot of claim 14 wherein the heel door includes padding located on the interior side for engaging and holding down the wearer's heel, and detachable locking means for releasably securing the heel door to the vamp shell to allow replacement of the heel door with a heel door having padding of different size to thereby change the heel hold-down characteristics of the boot.

17. The boot of claim 14 wherein the resilient body has a size which controls the forward lean angle and a resiliency which controls the flex of the upper shell assembly with respect to the lower vamp shell, and means for providing access to the pockets to allow replacement of the resilient body with a different resilient body.

18. The boot of claim 14 wherein the upper shell assembly includes a stop flange, the lower vamp shell includes a stop flange, and means for engaging the stop flanges to prevent further rotation of the upper shell assembly relative to the lower vamp shell.

19. A boot comprising:

a lower vamp shell, an upper shell assembly including a front section with a pair of downwardly extending legs located on each side of the lower vamp shell and a rear door, a pair of door pivots rotatably interconnecting the pair of extending legs to the sides of the rear door for backward rotation of the rear door to an open position which allows access to the upper shell assembly, closure means for securing the rear door against the front section when closed, a pair of primary pivots offset from the pair of door pivots for pivotally interconnecting the sides of the upper shell assembly to the sides of the lower vamp shell for rotatable motion of the upper shell assembly including the rear door with respect to the lower vamp shell, the pair of downwardly extending legs terminating below the pair of primary pivots and the pair of door pivots being located in the end regions of the pair of legs to allow the rear door to be swung open about pivots located below the pair of primary pivots.

20. The boot of claim 19 wherein the pair of primary pivots are located in the vicinity of the wearer's ankle, and the legs extend on the outside of the lower vamp shell with the pair of door pivots moving externally over the lower vamp shell as the upper shell assembly is pivotally moved by the wearer's leg with respect to the lower vamp shell.

21. The boot of claim 19 wherein one of the front section and rear door have a plurality of extending lips and the other of the front section and rear door have a plurality of recesses formed for slidably receiving the plurality of extending lips when the rear door is closed.

22. The boot of claim 19 wherein the lower vamp shell has a recessed rear edge adjacent a wearer's heel, a heel door covers the recessed rear edge and is openable to allow rear entry of a foot into the vamp shell, the rear door when closed overlapping the heel door and slidably moving thereagainst as the upper shell assembly pivotally moves with respect to the lower vamp shell.

23. The boot of claim 19 wherein the front section includes an upper receptacle, the lower vamp shell adjacent the front section includes a lower receptacle spaced from the upper receptacle and defining therebetween a compressible volume which varies as the upper shell assembly is pivotally moved with respect to the lower vamp shell, and a resilient body mounted between the upper and lower receptacles.

* * * * *